US011898272B2

(12) United States Patent
Schrempf et al.

(10) Patent No.: US 11,898,272 B2
(45) Date of Patent: Feb. 13, 2024

(54) CELLULOSE FILAMENT PROCESS

(71) Applicant: LENZING AKTIENGESELLSCHAFT, Lenzing (AT)

(72) Inventors: Christoph Schrempf, Bad Schallerbach (AT); Johann Pillichshammer, Frankenmarkt (AT); Andreas Gressenbauer, Schorfling am Attersee (AT); Ernst Reiter, Schorfling am Attersee (AT); Martin Neunteufel, Lantau Island (CN)

(73) Assignee: Lenzing Aktiengesellschaft, Lenzing (AT)

( * ) Notice: Subject to any disclaimer, the term of this patent is extended or adjusted under 35 U.S.C. 154(b) by 302 days.

(21) Appl. No.: 17/418,022

(22) PCT Filed: Dec. 20, 2019

(86) PCT No.: PCT/EP2019/086554
§ 371 (c)(1),
(2) Date: Jun. 24, 2021

(87) PCT Pub. No.: WO2020/136108
PCT Pub. Date: Jul. 2, 2020

(65) Prior Publication Data

US 2022/0112627 A1 Apr. 14, 2022

(30) Foreign Application Priority Data

Dec. 28, 2018 (EP) ..... 18248173

(51) Int. Cl.
*D01D 5/06* (2006.01)
*D01D 5/30* (2006.01)
*D01D 10/02* (2006.01)
*D01F 2/00* (2006.01)

(52) U.S. Cl.
CPC ..... *D01D 5/06* (2013.01); *D01D 5/30* (2013.01); *D01D 10/02* (2013.01); *D01F 2/00* (2013.01)

(58) Field of Classification Search
CPC ..... D01D 5/06; D01D 5/30; D01D 10/02; D01D 4/02; D01D 5/0069; D01F 2/00
See application file for complete search history.

(56) References Cited

U.S. PATENT DOCUMENTS

| | | | |
|---|---|---|---|
| 5,252,284 | A | 10/1993 | Jurkovic et al. |
| 5,589,125 | A | 12/1996 | Zikeli et al. |
| 5,601,234 | A | 2/1997 | Larue |
| 5,863,478 | A | 1/1999 | Ruf et al. |
| 5,942,327 | A | 8/1999 | Budgell et al. |

(Continued)

FOREIGN PATENT DOCUMENTS

| | | | |
|---|---|---|---|
| CN | 1189860 | A | 8/1998 |
| CN | 1511980 | A | 7/2004 |

(Continued)

OTHER PUBLICATIONS

Krüger, "Cellulosic Filament from the NMMO Process," Lenzinger Berichte Sep. 1994, pp. 49-52 (1994).

*Primary Examiner* — Nahida Sultana
(74) *Attorney, Agent, or Firm* — Venable LLP

(57) ABSTRACT

The present invention provides a process for the viable production of lyocell cellulose continuous filament yarns at very high production speeds.

10 Claims, 1 Drawing Sheet

(56) References Cited

U.S. PATENT DOCUMENTS

| | | | | |
|---|---|---|---|---|
| 5,968,434 | A | 10/1999 | Zikeli et al. | |
| 6,159,601 | A | 12/2000 | Pitowski et al. | |
| 6,190,596 | B1 | 2/2001 | Budgell et al. | |
| 6,241,927 | B1 | 6/2001 | Mülleder et al. | |
| 6,852,413 | B2 | 2/2005 | Lee et al. | |
| 6,902,804 | B2 | 6/2005 | Kwon et al. | |
| 6,983,779 | B2 | 1/2006 | Kwon et al. | |
| 7,097,344 | B2 | 8/2006 | Kwon et al. | |
| 7,364,681 | B2 | 4/2008 | Zikeli et al. | |
| 7,713,459 | B2 | 5/2010 | Kwon et al. | |
| 7,732,048 | B2 | 6/2010 | Kwon et al. | |
| 10,306,919 | B2 | 6/2019 | Jeong et al. | |
| 2004/0021246 | A1* | 2/2004 | Zikeli | B29C 48/05 425/464 |
| 2004/0126577 | A1 | 7/2004 | Lee et al. | |
| 2005/0019564 | A1 | 1/2005 | Kwon et al. | |
| 2005/0035487 | A1 | 2/2005 | Zikeli et al. | |
| 2005/0066646 | A1 | 3/2005 | Kwon et al. | |
| 2005/0160939 | A1 | 7/2005 | Kwon et al. | |
| 2007/0170609 | A1 | 7/2007 | Kwon et al. | |
| 2007/0241477 | A1 | 10/2007 | Kwon et al. | |
| 2009/0011234 | A1 | 1/2009 | Kwon et al. | |
| 2010/0187716 | A1* | 7/2010 | Yang | D02J 1/228 264/178 F |
| 2011/0218337 | A1 | 9/2011 | Kim et al. | |
| 2016/0235112 | A1 | 8/2016 | Jeong et al. | |
| 2020/0332442 | A1* | 10/2020 | Schrempf | D01D 7/00 |

FOREIGN PATENT DOCUMENTS

| | | | |
|---|---|---|---|
| CN | 1576403 | A | 2/2005 |
| CN | 1608150 | A | 4/2005 |
| DE | 199 54 152 | A1 | 7/2000 |
| EP | 0 853 146 | A2 | 7/1998 |
| EP | 0 823 945 | B1 | 10/2001 |
| EP | 2185754 | A2 | 5/2010 |
| JP | H09-508704 | A | 9/1997 |
| JP | 2001-316938 | A | 11/2001 |
| JP | 2004-211277 | A | 7/2004 |
| JP | 2006-138058 | A | 6/2006 |
| JP | 4104596 | B2 | 6/2008 |
| JP | 4127693 | B2 | 7/2008 |
| JP | 4234057 | B2 | 3/2009 |
| JP | 4593667 | B2 | 12/2010 |
| RU | 2636728 | C2 | 11/2017 |
| WO | 93/19230 | A1 | 9/1993 |
| WO | 96/18760 | A1 | 6/1996 |
| WO | 98/06754 | A1 | 2/1998 |
| WO | 01/81662 | A1 | 11/2001 |
| WO | 02/18682 | A1 | 3/2002 |
| WO | 02/072929 | A1 | 9/2002 |
| WO | 03/014429 | A1 | 2/2003 |
| WO | 03/014432 | A1 | 2/2003 |
| WO | 03/014436 | A1 | 2/2003 |
| WO | 2009031868 | A2 | 3/2009 |
| WO | 2015/046943 | A1 | 4/2015 |

* cited by examiner

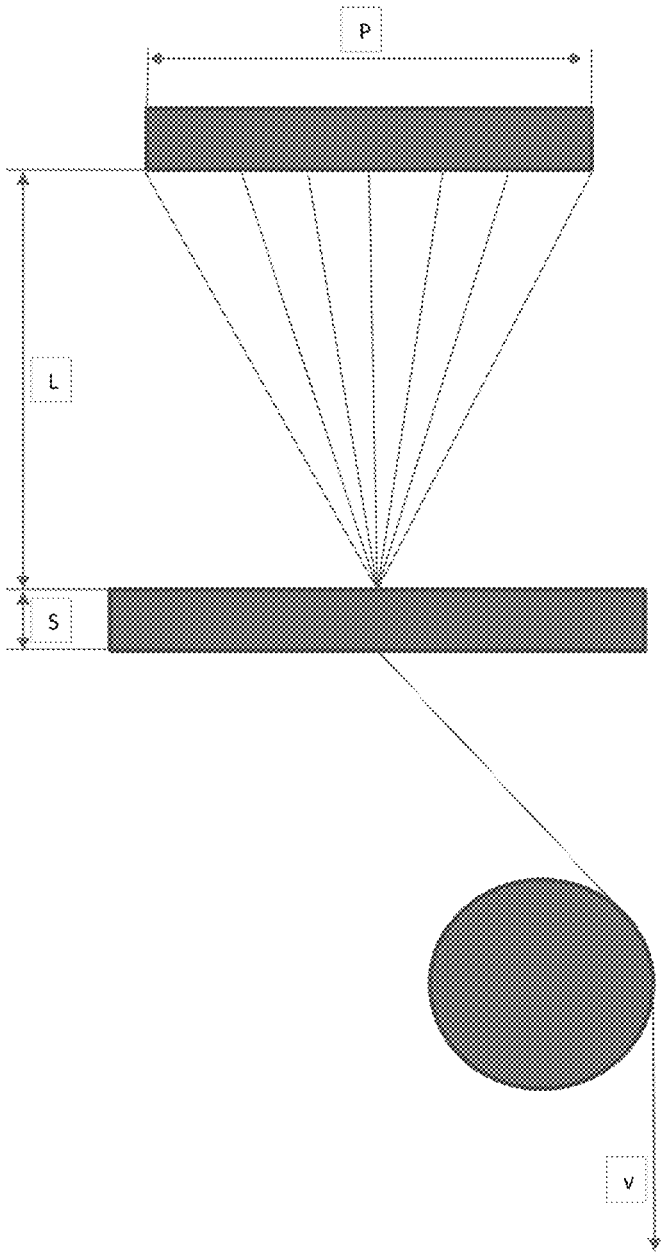
P
L
S
V

CELLULOSE FILAMENT PROCESS

The present application is a national-stage entry under 35 U.S.C. § 371 of International Patent Application No. PCT/EP2019/086554, published as WO 2020/136108 A1, filed Dec. 20, 2019, which claims priority to EP 18248173.9, filed Dec. 28, 2018, the entire disclosure of each of which is hereby incorporated by reference.

FIELD OF THE INVENTION

The present invention relates the production of cellulose filament yarns.

DESCRIPTION OF RELATED ART

Continuous filament yarns are widely used in the textile industry to produce fabrics with a distinct character compared to fabrics produced from yarns made using staple fibers. A continuous filament yarn is one in which all of the fibers are continuous throughout any length of the yarn. A continuous filament yarn will commonly consist of 10 to 300 or more individual filaments which are all parallel to each other and the axis of the yarn when produced. The yarn is produced by extruding a solution or melt of a polymer or a polymer derivative and then winding the yarn produced onto a bobbin or reel or by forming a cake by centrifugal winding.

Synthetic polymer continuous filament yarns are common. For example, nylon, polyester and polypropylene continuous filament yarns are used in a wide variety of fabrics. They are produced by melt spinning a molten polymer through a spinneret with a number of holes corresponding to the number of filaments required in the yarn produced. After the molten polymer has started to solidify, the yarn may be drawn to orient the polymer molecules and improve the properties of the yarn.

Continuous filament yarns can also be spun from cellulose derivatives such as cellulose diacetate and cellulose triacetate by dry spinning. The polymer is dissolved in a suitable solvent and then extruded through a spinneret. The solvent evaporates quickly after extrusion causing the polymer to precipitate in the form of filaments forming a yarn. The newly produced yarn may be drawn to orient the polymer molecules.

Continuous filament yarns can also be produced from cellulose using the viscose process. Cellulose is converted to cellulose xanthate by reaction with sodium hydroxide and carbon disulphide and then dissolved in a sodium hydroxide solution. The cellulose solution, commonly called viscose, is extruded through a spinneret into an acid bath. The sodium hydroxide is neutralised causing the cellulose to precipitate. At the same time, the cellulose xanthate is converted back to cellulose by reaction with the acid. The newly formed filament is drawn to orient the cellulose molecules, washed to remove reactants from the filament and then dried and wound onto a bobbin. In earlier versions of this process, the wet yarn was collected into a cake using a centrifugal winder—a Topham Box. The cake of yarn was then dried in an oven before winding onto a bobbin.

Continuous filament cellulose yarns are also produced using the cupro process. Cellulose is dissolved in a solution of cuprammonium hydroxide. The resulting solution is extruded into a water bath where the cuprammonium hydroxide is diluted and the cellulose precipitates. The resulting yarn is washed, dried and wound onto a bobbin.

Cellulosic continuous filament yarn produced by either the viscose or the cupro process can be made into fabrics by weaving or knitting or other fabric forming processes. Fabrics produced are used for a variety of applications including linings for outerwear, ladies blouses and tops, lingerie and prayer rugs. Yarns are also produced for use in the reinforcement of tyres and other rubber products.

Fabrics made from continuous filament cellulose yarns can have a high lustre. They are good at moisture handling to enhance the comfort of the wearer. They do not generate static electricity as readily as fabrics made using continuous filament synthetic yarns.

However, fabrics made from currently available continuous filament cellulose yarns generally have poor physical properties. The dry strength and the tear strength are poor compared to fabrics made from synthetic polymers such as polyester. The wet strength is much lower than the dry strength due to interactions between the cellulose and water. The abrasion resistance is low. The interactions with water also soften the cellulose causing the fabrics made from the yarn to be unstable when wetted.

Due to these deficiencies, the products which were originally made using continuous filament cellulose yarns are now mainly produced using synthetic polymer continuous filament yarns such as polyester and nylon.

However, synthetic yarns do show certain drawbacks. Fabrics made using them do not have the moisture handling capability of fabrics made from cellulose yarns. Synthetic fabrics can generate static electricity. Some people consider garments made from synthetic yarns much less comfortable to wear compared with cellulose containing fabrics.

Accordingly there is a need for continuous filament cellulose yarns which would allow to produce fabrics and other textile products that have the positive characteristics of currently available fabrics made from continuous filament cellulose yarns but with the performance usually associated with fabrics made using continuous filament synthetic yarns.

It has surprisingly been found that continuous filament yarns produced by the lyocell process have considerably higher tensile strength than filament yarns produced by the viscose process. This can result in fabrics with better strength, tear strength and abrasion resistance. The loss of strength when lyocell filaments are wetted is much lower than for viscose filaments. This means that lyocell fabrics are more difficult to deform when wet giving better fabric stability. Lyocell fabrics are also stronger when wet compared to equivalent viscose fabrics.

It has also been surprisingly found that fabrics produced from lyocell continuous filaments can have the lustre, moisture handling properties and low static generation that are the desirable characteristics of continuous filament viscose and cupro fabrics.

Lyocell technology is a technology based on the direct dissolution of cellulose wood pulp or other cellulose-based feedstock in a polar solvent (for example n-methyl morpholine n-oxide, hereinafter referred to as 'amine oxide') to produce a viscous highly shear-thinning solution which can be formed into a range of useful cellulose-based materials. Commercially, the technology is used to produce a family of cellulose staple fibers (commercially available from Lenzing AG, Lenzing, Austria under the trademark TENCEL®) which are widely used in the textile and nonwovens industries. Other cellulose products from lyocell technology such as filaments, films, casings, beads & nonwoven webs have also been disclosed.

EP 823945 B1 discloses a process for the manufacture of cellulose fibers, which comprises the extrusion and coagulation of a cellulose spinning solution in accordance with the lyocell process, mandatorily comprising a step of drawing the filaments and cutting the filaments into cellulose fibers, which may be used in various fields of application. Process step of drawing the coagulated cellulose filaments is essential according to the teaching of this prior art technology in order to obtain in particular staple fibers with a desired balance of properties.

EP 0 853 146 A2 discloses a process for the preparation of cellulosed based fibers. According to the teaching of this document two different raw materials having widely differing molecular weights are mixed in order to obtain fibers. WO 98/06754 discloses a similar method, which require that the two different raw materials are first dissolved separately, before admixing the prepared solution to obtain a spinning solution. DE 199 54 152 A1 discloses a method of preparing fibers, wherein spinning solutions having a relatively low temperature are employed.

The benefits of cellulose filament yarns produced from lyocell spinning solution have been described (Krüger, Lenzinger Berichte 9/94, S. 49 ff.). However, due to increasing demands regarding spinning efficiency, attempts have been made to increase spinning speeds in the lyocell process to values of several hundred meters per second. However, at such high spinning velocities various problems may occur, including unsatisfactory high proportion of defects in the individual filaments produced, which may result in a high proportion of products which are not suitable for further use and/or result in stoppage of production.

Accordingly, the required high spinning velocities, while maintaining filament quality, present the drawback that commercially viable processes are not yet know, as the filament and yarn quality obtained by prior art processes to form lyocell filaments are not satisfactory. In addition, prior art teachings regarding fiber and filament production from other process technologies (viscose, synthetic filaments) are not applicable to lyocell processes due to the demanding requirements of high polymer extension directly after extrusion followed by controlled solvent removal via liquor exchange.

The preparation of continuous filament lyocell yarns at high velocities therefore presents new process challenges compared to lyocell staple fibre production, primarily due to much higher production speeds, filament uniformity requirements and the need for exceptional process continuity:

Filament production speeds in excess of ten times faster than for staple fiber production are typical and the recent demands to further increase productions speeds increase the problems of process control.

In a continuous filament yarn product, properties of all individual filaments must be within a very narrow window of variability, for example to prevent problems such as variation in uptake of dye. For example, a coefficient of variance of denier distribution must be less than 5%. On the other hand, in a staple fiber process, there is much more scope for 'averaging out' of minor variations between individual filaments because each bale of fibers consists of several million individual fibers obtained from filaments which have been cut to required length and blended. An example of the formation of lyocell staple fibers is disclosed in EP 823 945 B1.

Very high purity levels of spinning solution are necessary to minimize filament breakage during the extension step. Breakages can lead to loss of individual filaments leading to yarns no longer complying with the required specification and, potentially, loss of spinning continuity. Staple fiber production processes are tolerant of a certain proportion of individual filament breakages.

Object of the Invention

Accordingly it is the object of the present invention to provide a process enabling the production of lyocell filaments and of lyocell multifilament yarns with a high quality at very high production speeds with a process control making the overall process commercially viable.

Brief Description of the Invention

Accordingly the present invention provides the process as defined in claim 1. Preferred embodiments are given in claims 2 to 10 and the specification.

BRIEF DESCRIPTION OF THE FIGURE

FIG. 1 shows a schematic representation of the relevant process parameters for which a process control to certain parameter windows is essential to enable the production of lyocell filaments and yarns according to the process according to the present invention.

DETAILED DESCRIPTION OF THE INVENTION

The limitations of the state of the art have been overcome by the invention disclosed herein. Namely the present invention provides a process for producing lyocell filaments and lyocell multifilament yarns as defined in claim 1. The present invention will be described in detail referring to the required process control in relation to the relevant process steps and parameters to be employed. It is to be understood, that these process steps and their respective preferred embodiments can be combined as appropriate and that the present application covers these combinations and discloses same, even if not explicitly described herein.

The inventors have determined, that for productions velocities of 400 m/min or more a desired process control, enabling the reliable production of high quality filaments and yarns, with filaments titer in the range of from 0.8 to 7.0 dtex, preferably 1.0 to 6.0 dtex, more preferably 1.3 to 4.8 dtex, including from 1.7 to 4.1 dtes, can be achieved, if the air gap provided after the spinning solution exits the spinning nozzles is adjusted in accordance with the following relation (1a):

$$L > \frac{v}{1000} \times \sqrt{1.7/\text{titer}} \times p \tag{1a}$$

In this relation L designates the length of the air gap (mm), v designates the production speed m/min), titer designates the titer of the individual filament (dtex) and p designates the length of the individual spinneret piece (mm) employed in the spinneret.

In a particular preferred embodiment the relation to be satisfied is as follows (1b):

$$L > F \times \frac{v}{1000} \times \sqrt{1.7/\text{titer}} \times p \tag{1b}$$

with F being 1.3 or more.

In embodiments F may also be 1.35 or more or even 1.4 or more, with an upper limit being 2.0, preferably 1.7 and most preferably 1.5. In some embodiments F may be from 1.3 to 1.5, or even from 1.3 to 1.4.

It has been found unexpectedly that by adjusting the process parameters length of air gap, length of spinneret piece, titer of individual filament and production speed in accordance with the above, a reliable process control is enabled so that even though very high production speeds are employed, filaments and yarns with a high quality (in particular satisfactory low proportion of defects) can reliably be produced. The present invention accordingly facilitates the evaluation of process conditions for the production of lyocell filaments and yarns since the adjustment of the relevant process conditions in accordance with the relations provided above provide a reliable process control, even for production size lyocell facilities. This reduces the time and capital otherwise required to evaluate such process conditions.

Extrusion of Filaments

In accordance with generally known requirements for lyocell spinning processes the uniformity and consistency of flow of the spinning solution through each spinneret nozzle hole further the process and helps to meet the quality requirements for the individual cellulose filaments and in turn also those for multifilament yarns. This is in particular relevant in view of the very high production speeds envisaged here for filament and filament yarn production, which are in the range of from 400 m/min and upwards. In accordance with the present invention production speeds of 400 m/min and upwards can be achieved, such as 500 m/min or more, preferably 700 m/min or more and even up to 1000 m/min or more, for example up to 2000 m/min. Suitable ranges are from 400 to 2000 m/min, such as from 500 to 1500 m/min or from 700 to 1000 m/min, including ranges such as from 700 to 1500 m/min.

Each spinneret piece used for extrusion of lyocell spinning solution has a number of nozzle holes corresponding to the number of filaments required for a continuous filament yarn. Multiple yarns can be extruded from a single jet by combining multiple spinneret pieces into a single spinneret plate, for example as disclosed in WO03014429 A1, incorporated herein by reference. These spinneret pieces are in principle rectangular or substantially rectangular pieces with a give number of nozzle holes. According to the present invention, the length of the spinneret piece employed is a relevant factor for the desired process control in accordance with the relations identified above. Generally it is preferred when the length of the spinneret piece in in the range of from 30 to 100 mm, preferably from 40 to 80 mm, and in particular from 50 to 70 mm. The length referred to here is the length of the two longer sides (which usually are of equal length) of the spinneret piece, even if the piece is not in a true rectangular shape but forms a parallelogram.

The number of nozzle holes for each filament yarn (i.e. for each spinneret piece) may be selected depending on the type of yarn intended, but the number is typically in the range of from 10 to 300, preferably 20 to 200, such as from 30 to 150.

Uniformity of spinning solution flow may be improved by providing a good temperature control within the spinneret and the individual nozzles. It is preferred, that during spinning the temperature variance within the nozzles (and between the nozzles is as small as possible, and preferably within ±2° C. or less. This may be achieved via a means of providing direct heating to the spinneret and the individual nozzles in a series of different zones, to enable compensation for any local differences in temperature of spinning solution and to give precise control of the temperature of the spinning solution as it is extruded from each spinneret nozzle. Examples of such temperature control means are disclosed in WO 02/072929 and WO 01/81662, incorporated herein by reference.

Spinneret nozzle profiles preferably are designed to maximize smooth acceleration of spinning solution through the nozzle while minimizing pressure drop. Key design features of the nozzle include, but are not limited to, a smooth inlet surface and sharp edges at nozzle outlet.

Initial Cooling

After exiting the spinning nozzles, the individual filaments are typically subjected to a cooling process, typically using an air flow. Accordingly, it is preferred to cool the filaments in this step by using an air draught, preferably a controlled cross draught in an air gap. The air draught should have a controlled humidity in order to obtain the desired cooling effect without detrimental effect on the quality of the fibers. Suitable humidity values are known to the skilled person. In any case, the present invention provides an air gap after the initial extrusion of the filaments, the length of which is determined by the other process parameters as identified above. However, according to a preferred embodiment of the present invention the length of the air gap is at most 200 mm, more preferable at most 150 mm. It has been found that limiting the air gap length according to these preferred embodiments secures an overall good process stability, yielding high quality filaments and yarns even at the very high production speeds envisaged here. In particular it has been found that very large air gaps rather lead to problems, as the individual filaments would move and touch, leading to filament fusion and poor product quality.

Thus, the present invention provides in relation with the length of the air gap a means to adjust the process conditions enabling the production of a desired filament titer at very high velocities.

As regards the optional cross draught arrangements reference can be made to WO03014436 A1, incorporated herein by reference. This document discloses a suitable cross draught arrangement. Uniform filament cooling over the full length of the air gap is preferred.

Cross-draught velocities are preferably much lower than used in lyocell staple fiber production. Suitable values are 0.5-3 msec, preferably 1-2 msec. Humidity values may be in the range of from 0.5 to 10 g water per kg air, such as from 2 to 5 g water per kg air. The air temperature preferably is controlled to a value of below 25° C., such as below 20° C.

Initial Coagulation of Filaments

After exiting the spinneret nozzles and having been cooled in the air gap, the filaments produced have to be treated to further initiate coagulation. This is achieved by means of entering the individual filaments into a coagulation bath, also called spinning bath or spin bath. It has been found that in order to achieve a high degree of uniformity of product quality, this further initial coagulation of the filaments preferably occurs within a small window, i.e. with only a minor variability, preferably at precisely the same point.

It has been found that traditional spin bath designs are often not suitable for this purpose because the hydrodynamic forces due to high filament speeds (above around 400 m/min) disturb the bath surface resulting in uneven initial coagulation (and variable air gap size) as well as potential filament fusion and other damage. It has been determined that in case of such problems it is preferable to use shallow spin baths, having a depth of below 50 mm.

Such spin baths are disclosed for example in WO03014432 A1, incorporated herein by reference, which discloses shallow spin bath depths in the range of from 5-40 mm, preferably 5 to 30 mm, more preferably 10-20 mm. The use of such shallow spin baths enables to control contact point of the spun filaments with the coagulation solution in the spin bath, thereby avoiding the problems which may occur when using conventional spin bath depths.

In addition it has been found that filament quality can also be improved if the concentration of amine oxide within the spin bath is controlled to values smaller than typically used in lyocell fiber production. Spin bath concentrations of below 25 wt.-%, more preferably below 20 wt.-% amine oxide, even more preferably preferably below 15 wt.-% have been found to improve filament quality. Preferred ranges for the amine oxide concentration are from 5 to 25 wt.-%, such as from 8 to 20 wt.-% or from 10 to 15 wt.-%. This is significantly below the range disclosed for lyocell staple fiber production. To enable the maintenance of such a low amine oxide concentration continuous monitoring of the composition of the spin bath is preferred, so that for example adjustments of the concentration may be carried out by replenishing water and/or by selective removal of excess amine oxide.

The temperature of this spin bath typically is in the range of from 5-30° C. preferably 8-16° C.

Similar to the preferred embodiments disclosed above for the spinning solution, high stringency spin bath liquor filtration is possible, to minimize potential to damage freshly-formed tender filaments by undesired solid impurities within the spin bath. This is particularly important at very high production speeds, in excess of 700 m/min.

Within the spinning bath the individual filaments of a target final yarn are brought together and are bundled into an initial multifilament bundle by means of the exit from the spinning bath, which is typically a ring shaped exit, which brings the filaments together and also serves to control the amount of spinning bath solution exiting the bath together with the filament bundle. Suitable arrangements are known to the skilled person. The shape as well as the choice of material for the ring shaped exit influences the tension applied to the filament bundles, as at least some of the filaments are in contact with the ring shaped exit. A skilled person will be aware of suitable materials and shapes for those exits from the spinning bath in order to minimize any negative impact on the filament bundle.

Accordingly, in a preferred embodiment of the process in accordance with the present invention, the process comprises the steps of manufacture of a spinning solution suitable for the lyocell process comprising from 10 to 15 wt %, preferably from 12 to 14 wt % of cellulose, wherein the cellulose preferably is as described below. This process furthermore comprises the step of extrusion of the spinning solution through extrusion nozzles while maintaining a temperature variability through the extrusion nozzles within a range of ±2° C. or less. The filaments thus produces are subjected to an initial cooling as described above, followed by the initial coagulation of filaments obtained in this manner occurs in a coagulation bath (spin bath) having a depth of less than 50 mm, preferably from 5 to 40 mm, more preferably from 10 to 20 mm.

The composition of the coagulation liquor employed in this coagulation bath shows a concentration of amine oxide of 23 wt % or less, more preferably below 20 wt %, and even more preferably below 15 wt %. Adjustment of this amine oxide content may be achieved by means of selective removal of amine oxide and/or by replenishing fresh water to adjust the concentration to the preferred ranges.

Such a process ensures that filaments with a high quality and, in particular, a high uniformity can be obtained, which particularly enter the coagulation bath in a manner ensuring uniform coagulation and therefore uniform filament properties. In addition, in embodiments of the process described above, it is preferred to adjust the distance between the individual filaments upon extrusion, for example by employing a wider nozzle separation, compared with standard lyocell staple fiber production processes, as further described below. These preferred process parameters and conditions enable, as indicated herein, the production of lyocell filaments with a high uniformity, while also enabling the desired high process velocities (spinning velocities of 400 m/min or more, more preferably 500 m/min or more, and in embodiments as high as 700 m/min or more). In this context, the present invention furthermore enables the continuous and long-term production of cellulose lyocell filaments and corresponding yarns as the process parameters and conditions as explained above avoid filament breakage or filament defects etc., which would require stoppage of filament and yarn production or discharge of produces filament/yarn.

The rheological properties of lyocell spinning solutions are important in view of the demands of high speed filament yarn production. For example, unacceptable numbers of filament breakages are encountered when using spinning solution compositions known for staple fiber production. It has been found that using a broad molecular weight distribution of the cellulose raw material meets the demands of high speed production in accordance with the present invention. A particular preferred broad molecular weight distribution cellulose material is a blend, obtained by blending 5-30 wt.-%, preferably 10 to 25 wt.-% of cellulose having a scan viscosity in the range of 450-700 ml/g with 70-95 wt.-%, preferably 75 to 90 wt.-% cellulose having a scan viscosity in the range of 300-450 ml/g, wherein the two fractions have a difference in scan viscosity of 40 ml/g or more, preferably 100 ml/g or more. The scan viscosity is determined in accordance with SCAN-CM 15:99 in a cuprietylenediamine solution, a methodology which is known to the skilled person and which can be carried out on commercially available devices, such as the device Auto PulpIVA PSLRheotek available from psl-rheotek.

To obtain such a cellulose raw material (for example from woodpulp) to achieve required molecular polydispersity blends of different types of starting materials may be used. Optimum blend ratios will depend on actual molecular weight of each blend component, filament production conditions and specific product requirements of the filament yarn. Alternatively, required cellulose polydispersity could also be obtained for example during manufacture of woodpulp, via blending prior to drying. This would remove the requirement to carefully monitor and blend pulp stocks during lyocell manufacture.

The overall content of cellulose in the spinning solution typically is from 10 to 20 wt.-%, preferably 10 to 16 wt.-%, such as from 12 to 14 wt.-%. As the skilled person is aware of the required components for spinning solutions for a lyocell process, no further detailed explanations of the components and the general production method is deemed to be required here. Reference in this respect is made to U.S. Pat. No. 5,589,125, WO 96/18760, WO 02/18682 and WO 93/19230, incorporated herein by reference.

To further control the process in accordance with the present invention, it is preferred to employ high levels of process monitoring and control to ensure uniformity of composition of the spinning solution. This may include in-line measurement of spinning solution composition/pressure/temperature, in-line measurement of particulate content, in-line measurement of spinning solution temperature distribution in jets/nozzles and regular off-line cross-checks.

It is further preferred to control and, if required to improve the quality of the lyocell spinning solution used in the present invention, as contents of large particles can result in unacceptable breaks in individual filament as they are being formed. Examples of such particles are impurities, such as sand, etc. but also gel particles comprising cellulose not sufficiently dissolved. One option to minimize the content of such solid impurities are filter processes. Multi-stage filtration of the spinning solution is the optimum way to minimize solid impurities. A skilled person will understand that greater filter stringencies are required for finer filament titers. Typically, for example, depth filtration with an absolute stopping power around 20 microns has been found to be effective for 1.3 decitex filaments. 15 micron absolute stopping power is preferred for finer filament decitex. Devices and process parameters for carrying out filtering are known to the skilled person.

In addition it has been found suitable to adjust the viscosity of the spinning solution to a range of from 500-1350 Pa's, measured at a shear rate of 1.2 (1/s) at 110° C.

The temperature of the spinning solution during its preparation typically is in the range of form 105 to 120° C., preferably 105 to 115° C. Prior to the actual spinning/extrusion the solution, optionally after filtering, is heated to a higher temperature, using processes and devices known to the skilled person, of typically from 115 to 135° C., preferably 120 to 130° C. This process, together with a filtering step increases the homogeneity of the spinning solution after its initial preparation in order to provide the spinning solution (sometimes called spinning mass) suitable for extrusion through the spinning nozzles. This spinning solution preferably is then, prior to extrusion/spinning, brought to a temperature of from 110° C. to 135° C., preferably 115° C. to 135° C., a process which may include intermediate cooling and heating stages as well as tempering stages (stages where the spinning solution is kept at a given temperature for a certain time). Such processes are known to the skilled person.

Filament Extension

After exiting the spinning bath the multifilament bundles are taken up, typically by means of a guidance roller which directs the bundle, which will yield the final yarn, towards the subsequent processing stages, such as washing, drying and winding. During this step preferably no stretching of the filament bundle occurs. The distance between the exit from the spinning bath and the contact with the guidance roller may be selected according to need and distances of between 40 and 750 mm, such as from 100 to 400 mm have been shown as being suitable. It has been found that this process step can provide further options to control and influence product quality. In this process step for example filament crystalline structure may be adjusted, thereby achieving the desirable properties of lyocell continuous filament yarns. As indicated above, and as derivable form the wording of claim 1, success in this process step has been found to be closely linked to the adjustment of process conditions according to the relations disclosed above.

As indicated above, a means such as a guidance roller takes up the filaments, assembles same to form the initial yarn and guides the yarn thus obtained towards further processing steps. In accordance with the present invention it is preferred, that a maximum tension applied to the filament bundle at the contact point of the filament bundle (yarn) with the guidance roller is $(4.2\times\text{filament number/filament titer})^{0.69}$ (cN) or less. This tension means the tension applied to the filaments/filament bundle from the point of exit from the spinning nozzles to the fist contact point, for example with the guidance roller provided after the coagulation step. The formula provided above defines, by means of illustration, that the maximum tension, for example for a filament bundle of 60 filaments with a yarn titer of 80 dtex (individual filaments have a titer of 1.33 dtex), that the maximum tension is $(4.2\times60:1.33)^{0.69}$ accordingly 37.3 cN.

y maintaining such a specified maximum tension it can be ensured that filament breakage is prevented so that high quality yarns may be obtained. In addition this helps to ensure that the filament production process can run for the required times without disturbance. A skilled person will understand that the tension referred to herein is a tension which is to be measured using samples taken from the overall process by using a three roll testing apparatus Schmidt-Zugspannungsmessgerät ETB-100. The tension measured for filaments and filament bundles at the designated point of contact referred to herein may, using the process parameters disclosed here in the context of the present invention, be used to control product quality and process stability, in particular by adjusting the composition of the spinning solution, the spin bath depth and the spin bath liquor (coagulation bath) composition, the air cross draught as well as spinneret design, such as nozzle design and nozzle separation, in order to adjust the tension values to values conforming to the equation provided above.

Filament Washing.

As the filaments after initial coagulation and cooling still contain amine oxide, the filaments and/or yarns obtained typically are subjected to washing. Amine oxide may be washed from the newly formed yarns via a counter-current flow of demineralised water or other suitable liquid, typically at 70-80° C. As with the earlier process steps, it has been found that traditional washing techniques, for example use of troughs, may pose problems in view of the high production speeds above around 400 m/min. In addition, uniform application of wash liquor to each individual filament is preferred, to obtain a high quality product. At the same time minimal contact between the tender filaments and washing surfaces is preferable in order to maintain integrity of the filaments, to achieve target yarn properties. Further, individual filament yarns must be washed close together and line length should be minimized to enable viable process economics. In view of the above it has been found that a preferred washing process involves the following, alone or in combination:

Washing preferably is carried out using a series of driven rollers and each yarn is subjected individually to a series of wash liquor impregnation/liquor removal steps.

It has been found beneficial to provide a means of stripping or spinning liquor uniformly from each yarn filament, without damaging the tender filaments, after each wash impregnation step. This may for example be achieved via a suitably designed and positioned pin guides. The pin guides may, for example be constructed with a matt chrome finish. The guides allow close spacing of filament yarns (around 3 mm), good contact with filaments to give uniform liquor removal and low tension to minimize filament damage.

Optionally, an alkaline washing step may be included to increase removal efficiency of residual solvent from the filaments.

Used wash liquor (after first pin guide) typically has a concentration of 10-30%, preferably 18-20% amine oxide prior to return to solvent recovery.

A 'soft finish' may be applied to aid further processing. Types and application methods will be known to those skilled in the art. For example, a 'lick-roller' arrangement applying around 1% finish on the filaments, followed by a nip roller to control yarn tensions into the dryer has been found to be effective.

Yarn Drying

Again, good control of this step assists in the development of optimal yarn properties and minimizing potential for filament damage. Drying means as well as drying parameters are known to the skilled person. Preferred embodiments are defined in the following:

The dryer consists for example of 12-30 heated drums of around 1 m diameter. Individual speed control is preferred to ensure filament tension is kept low and constant, preferably below 10 cN, preferably below 6 cN. Spacing between yarns through drying may be around 2 to 6 mm.

Initial temperature in dryer is around 150° C. In later stages of the drying process temperatures may be lower, as drying progresses.

An antistatic agent and/or a soft finish may be applied to the filament yarns after drying, by means known to those skilled in the art.

Further process steps, for example combining, texturising or intermingling yarns, may be applied after drying and prior to collection, using processes known to the skilled person. If desired, a soft finish may be applied to the yarns prior to the above identified steps.

Collection of Yarns

Yarns may be collected using standard winding equipment. A suitable example is a bank of winders. Winder speed is used to fine tune process speeds upstream to maintain low and constant yarn tension.

A skilled person will understand that various modifying substances, such as dyestuffs, antibacterial products, ion-exchanger products, active carbon, nanoparticles, lotions, fire-retardant products, superabsorbers, impregnating agents, dyestuffs, finishing agents, crosslinking agents, grafting agents, binders; and mixtures thereof can be added during preparation of the spinning solution or in the washing zone, as long as these additions do not impair the spinning process. This allows to modify the filaments and yarns produced in order to meet individual product requirements. The skilled artisan is well aware of how to add such above-referenced materials in which step of the lyocell filament yarn production process. In this regard it has been found that many desirable modifying substances which would normally be added at the washing stage will not be effective with the filament yarn route because of the high line speeds and hence short residence times. In order to introduce these modifying substances an alternative approach is to collect fully washed but 'never-dried' filament yarns and submit these to further processing batch-wise where residence time would not be a limiting factor.

An illustration of the relevant part of the process in accordance with the present invention is described by means of reference to FIG. 1. In FIG. 1, item (p) shows the length of the spinneret piece, with the item (L) designating the length of the air gap. The reservoir containing the spinning solution and any preceding steps, such as filtering steps, are not shown in FIG. 1 but the skilled person will understand how the spinning solution enters into the spinneret and the spinneret piece. Item (S) designates the precipitation or coagulation bath while item (v) represents the production speed, which is typically measured as m yarn taken up after the coagulation bath per minute (m/min).

In accordance with the process as described herein, cellulose filaments as well as cellulose yarns being bundles of lyocell filaments may be produced. The properties of the filaments and yarns produced may be adjusted in accordance with the respective requirements for the desired end-use, such as number of filaments per yarn, filament tighter, total yarn tighter as well as other properties of the filaments and yarns.

The following examples illustrate the present invention further:

Employing a spinneret with spinneret pieces with a length of 65 mm lyocell filaments were spun and lyocell yarns were produced at high production speeds. In each group of production sets identical spinning solutions were employed.

GROUP 1

Titer 1.3 dtex/production speed 700 m/min

Yarns were produced once with an air gap of 70 mm and once with an air gap of 120 mm. In both cases lyocell yarns would be obtained, however, while the defect rate for the first set (air gap 70 mm) was 13.3 per kg yarn, this defect rate dropped to 0 when using the longer air gap of 120 mm.

GROUP 2

Titer 1.3 dtex/production speed 700 m/min

Using a different type of spinning solution, compared with the sets of GROUP 1 yarns were produced once with an air gap of 70 mm and once with an air gap of 95 mm. In both cases lyocell yarns yould be obtained, however, while the defect rate for the first set (air gap 70 mm) was 7.2 per kg yarn, this defect rate dropped to 1.9 when using the longer air gap of 95 mm.

The results of GROUP 1 and 2 show that when adjusting the process parameters to relation (1a) it was possible to produce lyocell filaments and yarns at very high productions speeds of 700 m/min. These results furthermore show that by adjusting the process parameters to also comply with relation (1b) improves vastly the quality of the filaments and yarns obtained, as the defect rates can be reduced to highly satisfactory values, enabling in particular the use of the produced materials in high demanding fields of application.

GROUP 3

Titer 1.3 dtex

Yarns were produced at production speeds of 600, 700 and 900 m/min, with air gaps of 60 mm for the first two production speeds and with an air gap of 95 mm for the third set. In all three cases lyocell yarns yould be obtained, however, while the defect rate for the first set (air gap 60 mm) was 8 per kg yarn, this defect rate increased to 13.5 when increasing production speed to 700 m/min without increasing the length of the air gap. Further increasing the production speed to 900 m/min while also increasing the length of the air gap to 95 mm dropped the defect rate to 1.9.

The results of GROUP 3 again show that when adjusting the process parameters to relation (1a) it was possible to produce lyocell filaments and yarns at very high productions speeds of from 600 to 900 m/min. These results furthermore show that by adjusting the process parameters to also comply with relation (1b) improves vastly the quality of the filaments and yarns obtained, as the defect rates can be reduced even when increasing the production speed to very high values such as 900 m/min.

GROUP 4

Air gap 95 mm

Yarns were produced once with a titer of 1.3 dtex and at a production speed of 350 m/min and once with a titer of 4.1 dtex at a production speed of 400 m/min. In the first set, with a slow production speed the defect rate was 9.6, while for the second set the defect rate dropped to 1.9. The results of GROUP 4 show that the slight increase of production speed with an increase of the titer produced results in process conditions satisfying the relation defined by the present invention, so that a high quality yarn was obtained.

GROUP 5

Titer 1.3 dtex

Yarns were produced with a titer of 1.3 dtex and at a production speed of 700 m/min, once with an air gap of 95 mm and once with an air gap of 120 mm In the first set the defect rate was 2, while for the second set the defect rate dropped to 0. The results of GROUP 5 again show that by selecting production parameters in accordance with the present invention high quality fibers can be produced without laborious pre-trials for finding appropriate production parameters.

What is claimed is:

1. A process for the production of lyocell type cellulose filament yarns from a lyocell spinning solution of cellulose in an aqueous tertiary amine oxide comprising the following steps, wherein the process conditions are adjusted so that relation (1a) is fulfilled:

$$L > \frac{v}{1000} \times \sqrt{1.7/\text{titer}} \times p \quad (1a)$$

wherein L designates the length of the air gap (mm), v designates the production speed m/min), titer designates the titer of the individual filament (dtex) and p designates the length of the individual spinneret piece (mm) employed in the spinneret, and wherein v is 400 m/min or more.

2. The process according to claim 1, wherein the process conditions are adjusted so that relation (1b) is fulfilled:

$$L > F \times \frac{v}{1000} \times \sqrt{1.7/\text{titer}} \times p \quad (1b)$$

with F being 1.3 or more.

3. The process according to claim 1, wherein a multifilament yarn is produced.

4. The process according to claim 1, wherein v is from 400 to 2000 m/min.

5. The process according to claim 1, wherein the titer of the individual filaments is from 1.0 to 6.0 dtex.

6. The process according to claim 1, wherein L is at most 150 mm.

7. The process according to claim 1, wherein p is from 40 to 80 mm.

8. The process according to claim 1, wherein the filaments are further solidified in a coagulation bath having a depth of from 5 to 50 mm.

9. The process according to claim 1, wherein L is from 90 to 150 mm.

10. The process according to claim 1, wherein the temperature variability through the extrusion nozzles is controlled to ±2° C. or less.

* * * * *